US011363366B2

(12) United States Patent
Nageno et al.

(10) Patent No.: US 11,363,366 B2
(45) Date of Patent: Jun. 14, 2022

(54) HEADPHONE DEVICE

(71) Applicant: SONY CORPORATION, Tokyo (JP)

(72) Inventors: Koji Nageno, Tokyo (JP); Kenichi Oide, Tanjung Tokong (MY); Shinsuke Kanayama, Tanjung Tokong (MY); Pingwee Chia, Gegulor (MY); Chinngiap Heng, Simpang Ampat (MY)

(73) Assignee: SONY CORPORATION, Tokyo (JP)

( * ) Notice: Subject to any disclaimer, the term of this patent is extended or adjusted under 35 U.S.C. 154(b) by 308 days.

(21) Appl. No.: 16/332,679

(22) PCT Filed: Dec. 6, 2017

(86) PCT No.: PCT/JP2017/043840
§ 371 (c)(1),
(2) Date: Mar. 12, 2019

(87) PCT Pub. No.: WO2018/116834
PCT Pub. Date: Jun. 28, 2018

(65) Prior Publication Data

US 2021/0281944 A1 Sep. 9, 2021

(30) Foreign Application Priority Data

Dec. 21, 2016 (MY) ..... PI2016704739

(51) Int. Cl.
*H04R 1/10* (2006.01)
*H04R 7/12* (2006.01)

(52) U.S. Cl.
CPC ..... *H04R 1/1083* (2013.01); *H04R 1/1008* (2013.01); *H04R 7/127* (2013.01); *H04R 2410/05* (2013.01)

(58) Field of Classification Search
CPC .... H04R 1/1083; H04R 1/1008; H04R 7/127; H04R 2410/05; H04R 9/06; H04R 9/025
USPC ..... 381/71.6
See application file for complete search history.

(56) References Cited

U.S. PATENT DOCUMENTS

2009/0136055 A1 5/2009 Grell et al.
2012/0328147 A1 12/2012 Kim et al.

FOREIGN PATENT DOCUMENTS

CN 101300893 A 11/2008
CN 102948171 A 2/2013
CN 107409259 A 11/2017
DE 102005052548 A1 5/2007
EP 1946604 A1 7/2008
EP 3267694 A1 1/2018
(Continued)

OTHER PUBLICATIONS

International Search Report and Written Opinion of PCT Application No. PCT/JP2017/043840, dated Jan. 30, 2018, 10 pages of ISRWO.

(Continued)

*Primary Examiner* — Vivian C Chin
*Assistant Examiner* — Friedrich Fahnert
(74) *Attorney, Agent, or Firm* — Chip Law Group

(57) ABSTRACT

There is provided a headphone device including: an external magnet type magnet unit that is disposed outside a voice coil, and vibrates the voice coil; and a diaphragm that is vibrated by vibration of the voice coil, and formed of a material in which a dome section having an outward concave shape on an inner circumference of the voice coil is continuous with an edge section outside the voice coil.

2 Claims, 11 Drawing Sheets

(56) References Cited

FOREIGN PATENT DOCUMENTS

| | | | |
|---|---|---|---|
| GB | 219470 | A | 7/1924 |
| JP | 51-4328 | U | 1/1976 |
| JP | 2009-515389 | A | 4/2009 |
| JP | 2013-522946 | A | 6/2013 |
| JP | 2016-100647 | A | 5/2016 |
| KR | 10-2008-0071147 | A | 8/2008 |
| KR | 10-2011-0102182 | A | 9/2011 |
| WO | 2007/051606 | A1 | 5/2007 |
| WO | 2015/187715 | A1 | 12/2015 |
| WO | 2016/170595 | A1 | 10/2016 |

OTHER PUBLICATIONS

Office Action for JP Patent Application No. 2019-516556 dated Jan. 25, 2022, 05 pages of English Translation and 03 pages of Office Action.

[Fig. 1]
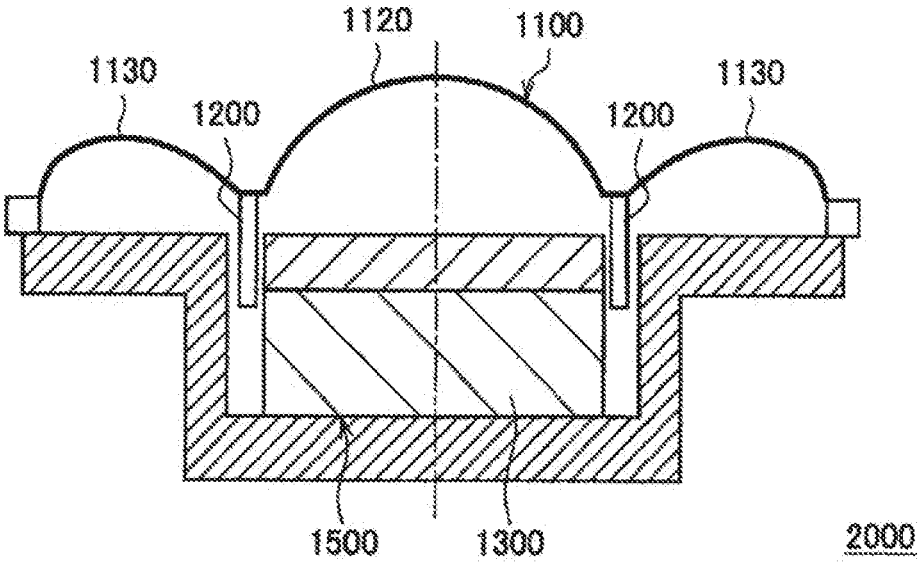

[Fig. 2]
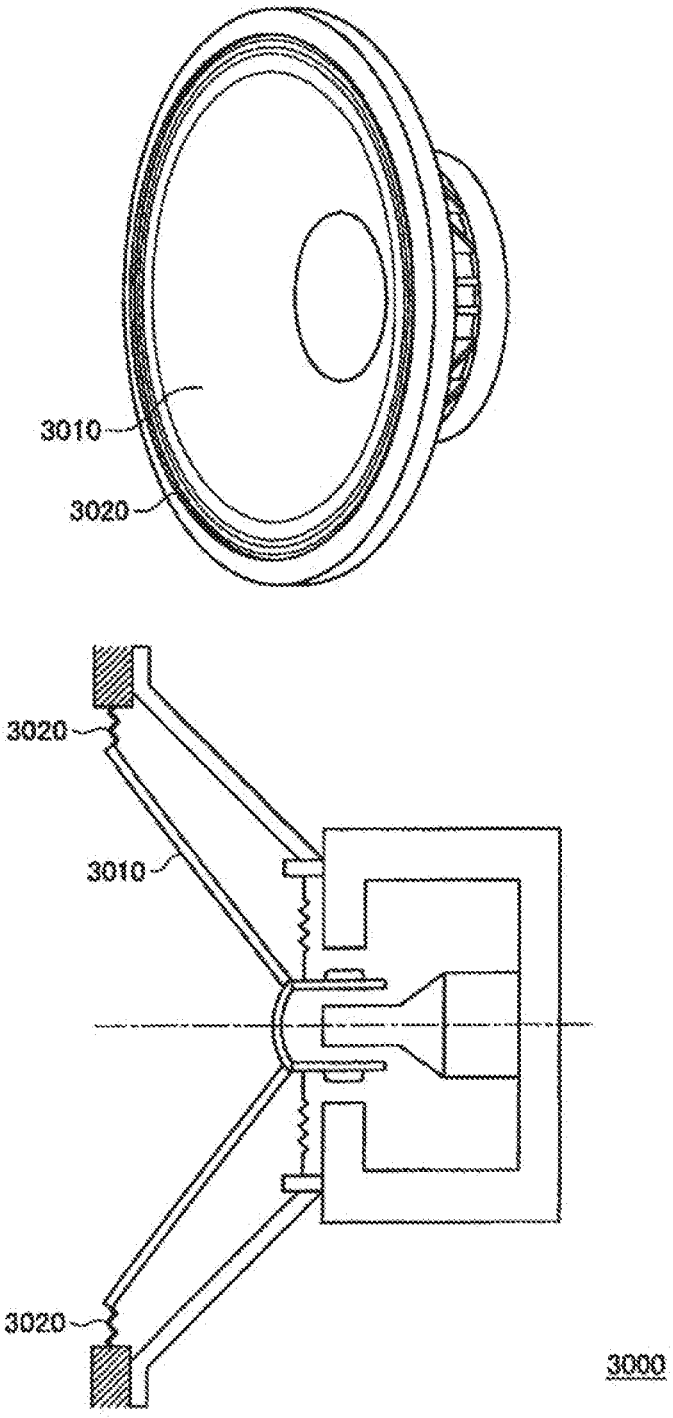

[Fig. 3]
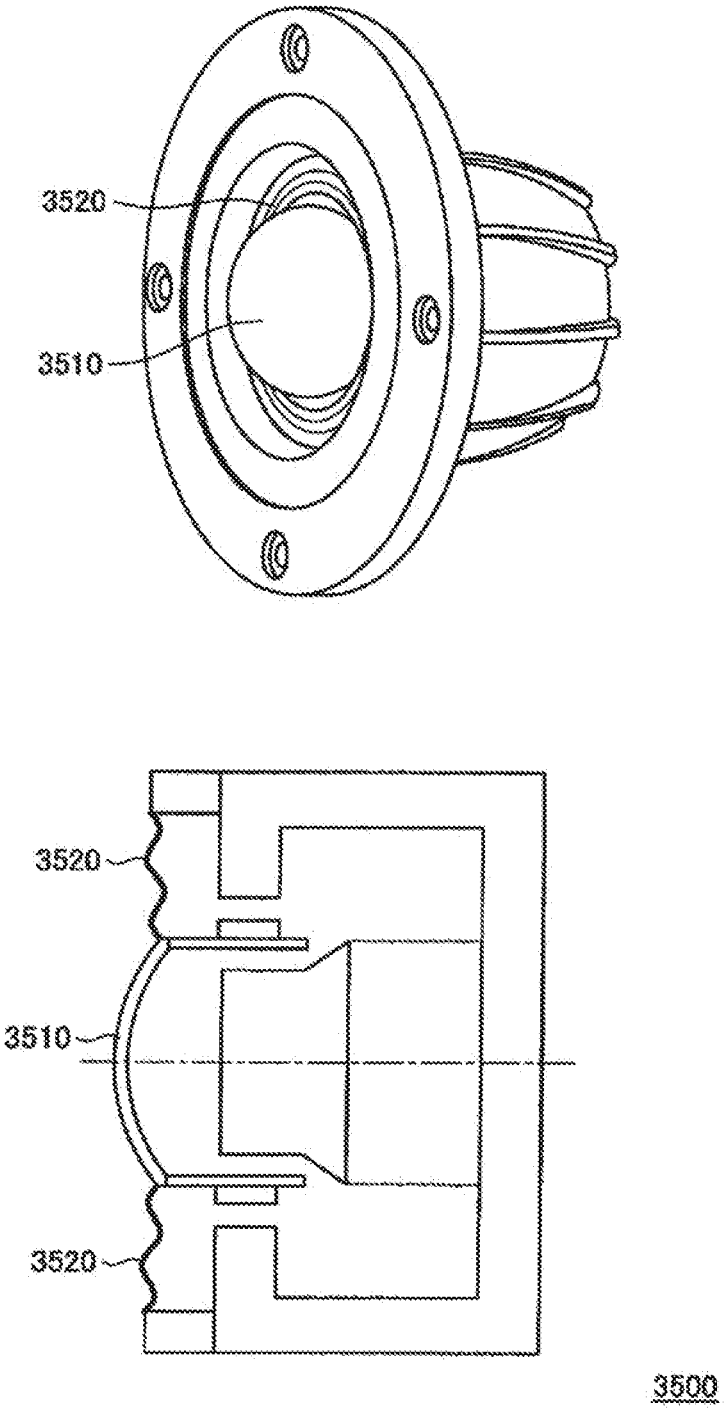

[ Fig. 4]
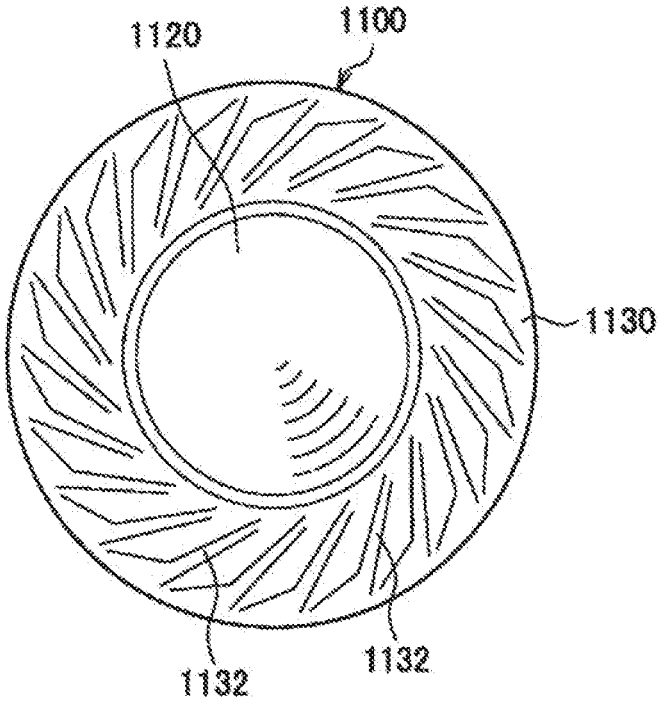
[Fig. 5]
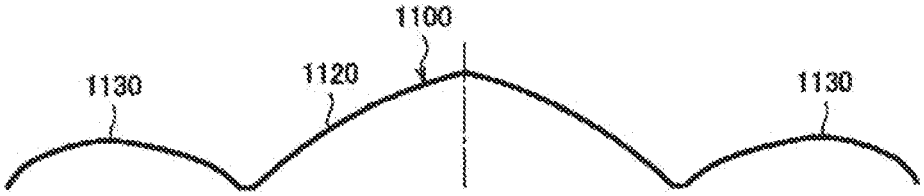
[Fig. 6]
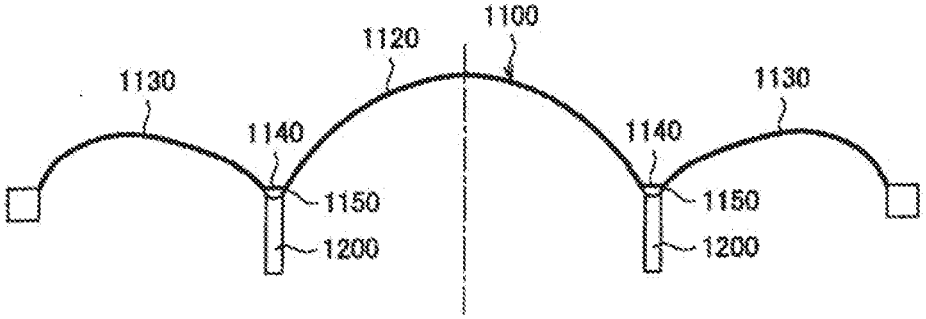

[Fig. 7]
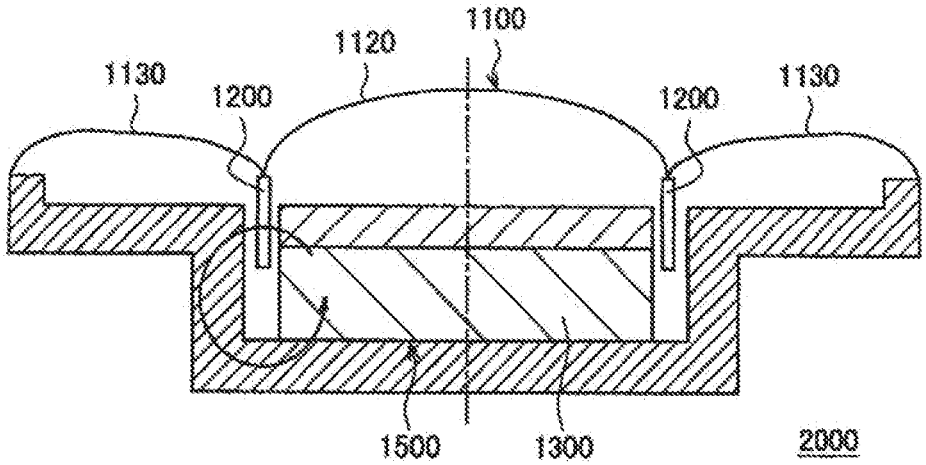
[Fig. 8]
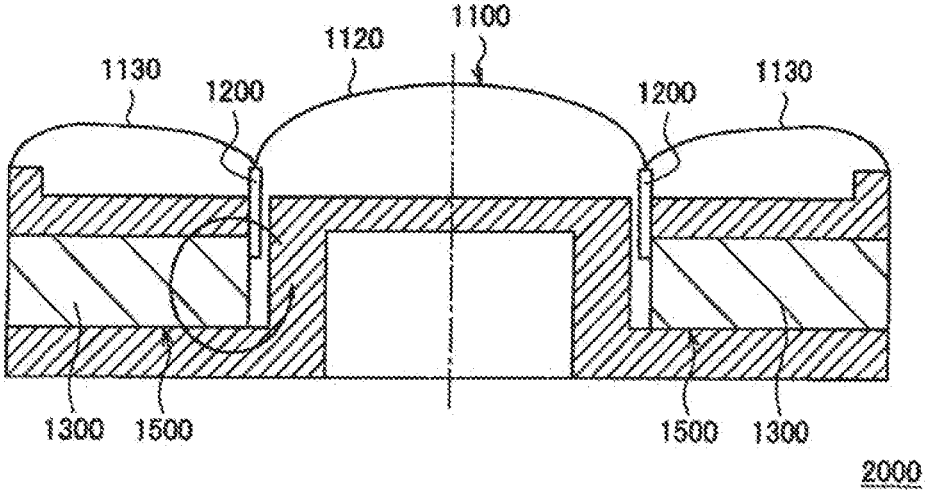
[Fig. 9]
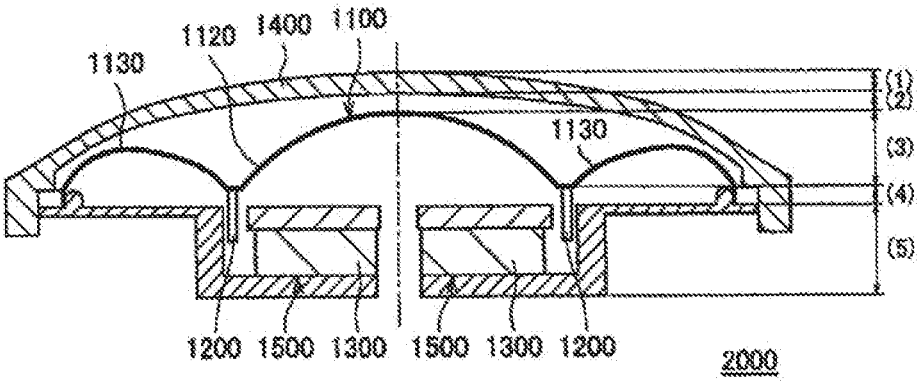

[Fiig. 10]
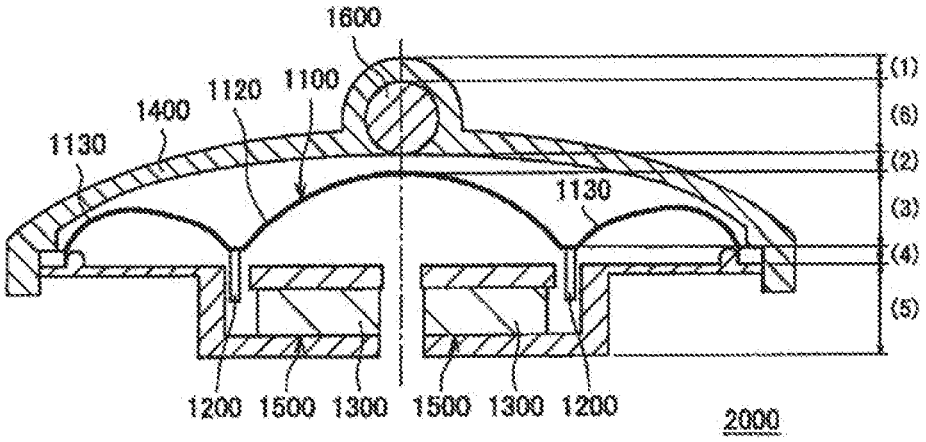

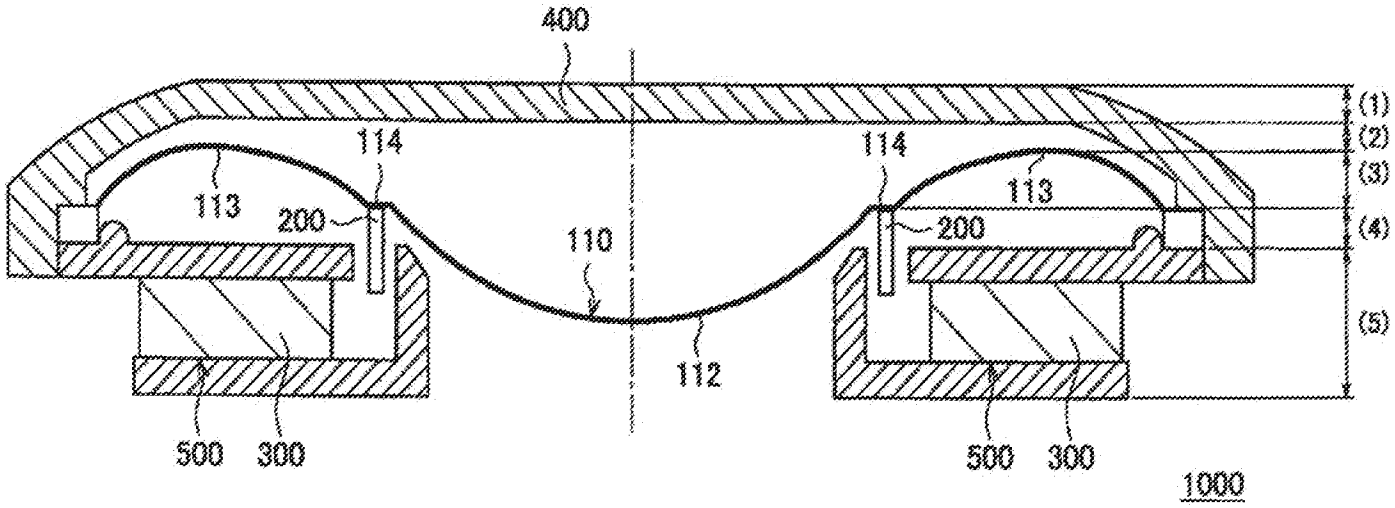
[Fig. 11]

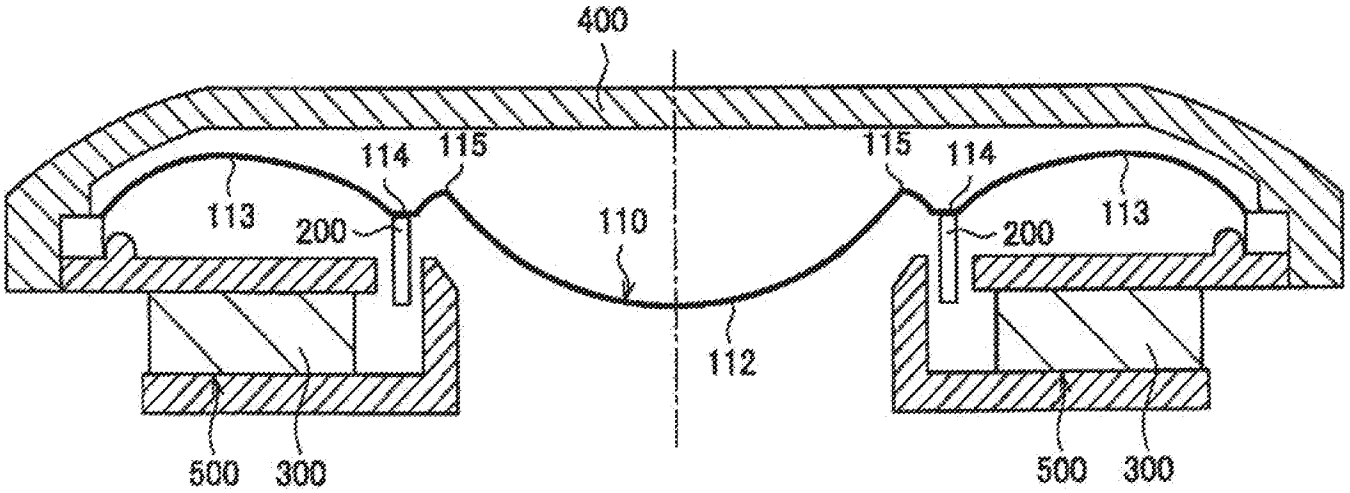
[Fig. 12]

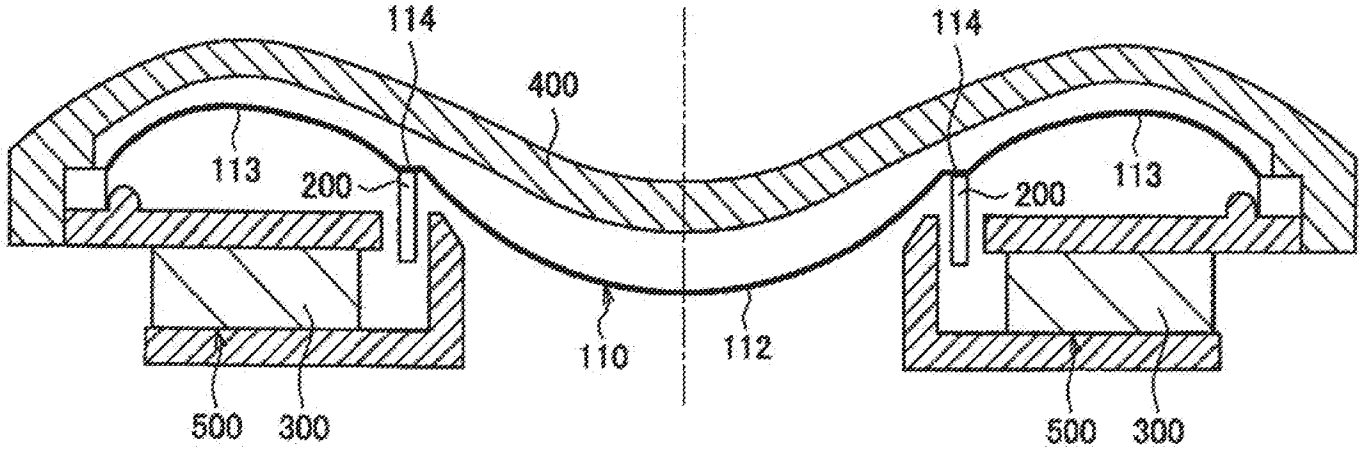
[Fig. 13]

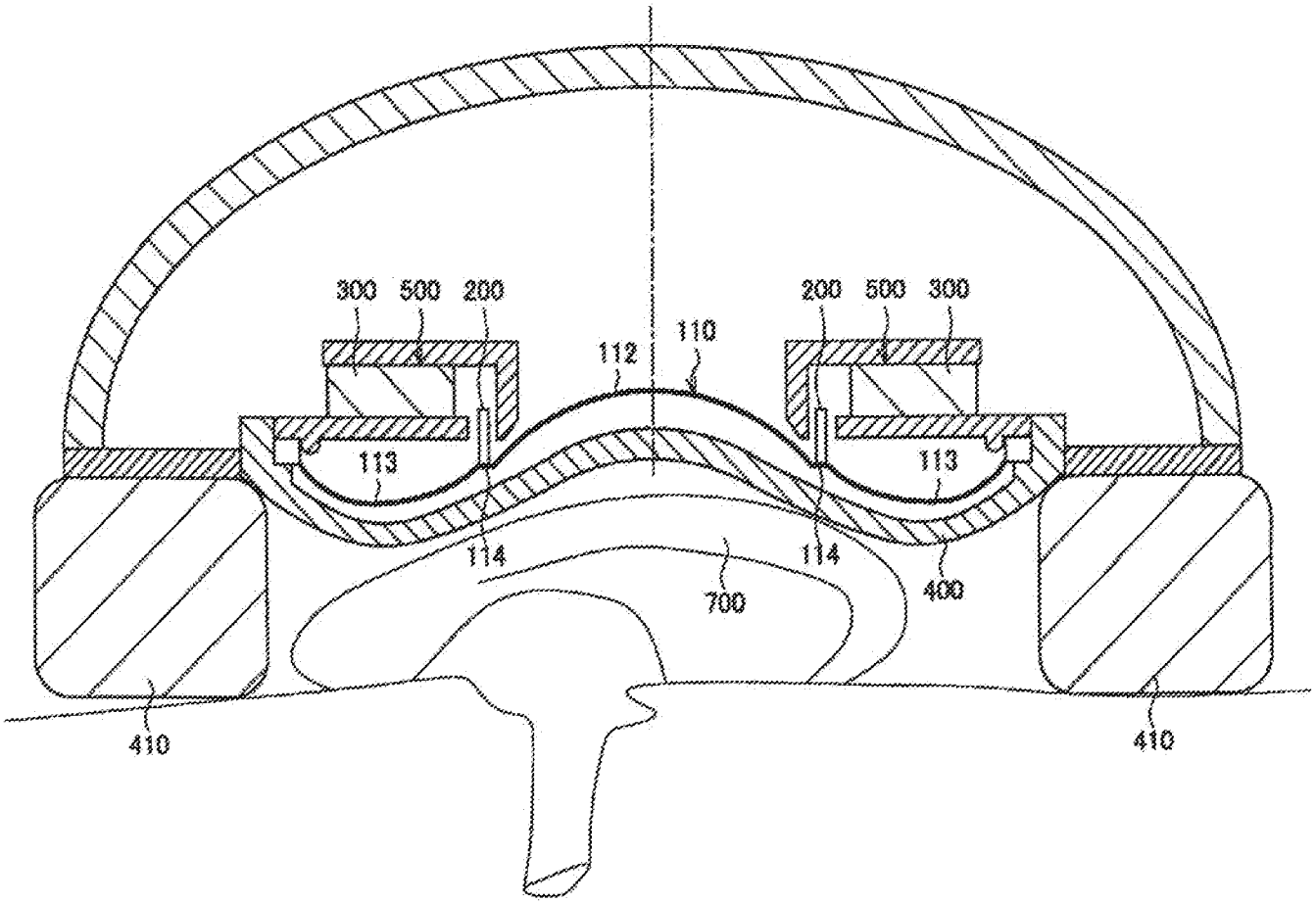
[Fig. 14]

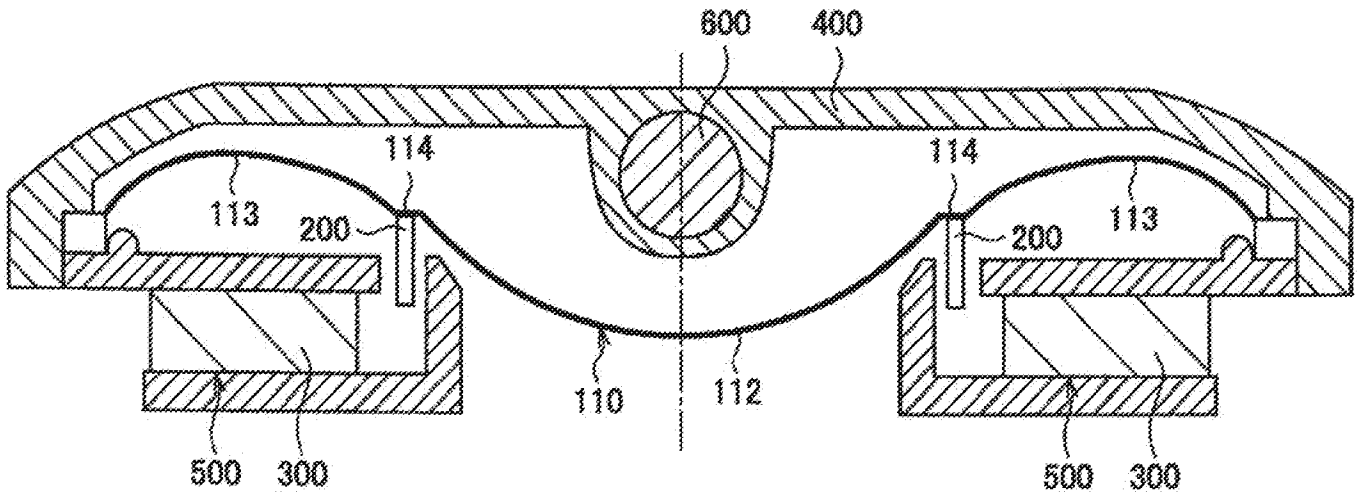
[Fig. 15]

HEADPHONE DEVICE

CROSS REFERENCE TO RELATED APPLICATIONS

This application is a U.S. National Phase of International Patent Application No. PCT/JP2017/043840 filed on Dec. 6, 2017, which claims priority benefit of Malaysian Patent Application No. PI2016704739 filed in the Malaysia Patent Office on Dec. 21, 2016. Each of the above-referenced applications is hereby incorporated herein by reference in its entirety.

TECHNICAL FIELD

The present disclosure relates to a headphone device.

For example, JP 5194434B describes a technique for making noise cancelling possible in wide bands, and stably offering a significant noise reduction effect.

BACKGROUND ART

The drivers of typical headphone devices are configured as dynamic drivers, and the diaphragms are vibrated by the voice coils to generate sounds. Each diaphragm then has a dome section that translates inside the voice coil in accordance with the amplitude of the voice coil, and an edge section that transforms, stretches, and shrinks outside the voice coil in accordance with the amplitude.

The shape of the diaphragm has considerable influence on the thickness of the driver. Diaphragms have each had an outward convex shape, resulting in the increased thickness of the driver. Especially when a headphone device has a noise cancellation function as described in JP 5194434B, the installation of a microphone further increases the thickness of the driver.

SUMMARY

It is then desirable to reduce the thickness of the driver section of a headphone device.

According to an embodiment of the present disclosure, there is provided a headphone device including: an external magnet type magnet unit that is disposed outside a voice coil, and vibrates the voice coil; and a diaphragm that is vibrated by vibration of the voice coil, and formed of a material in which a dome section having an outward concave shape on an inner circumference of the voice coil is continuous with an edge section outside the voice coil.

According to an embodiment of the present disclosure as described above, it is possible to reduce the thickness of the driver section of a headphone device.

Note that the effects described above are not necessarily limitative. With or in the place of the above effects, there may be achieved any one of the effects described in this specification or other effects that may be grasped from this specification.

BRIEF DESCRIPTION OF DRAWINGS

FIG. 1 is a schematic cross-sectional view illustrating a headphone device including a dynamic headphone driver;

FIG. 2 is a schematic diagram illustrating a configuration of a typical speaker;

FIG. 3 is a schematic diagram illustrating a configuration of a typical speaker;

FIG. 4 is a plan view illustrating a diaphragm of the headphone device;

FIG. 5 is a schematic cross-sectional view illustrating a shape of a cross section of the diaphragm;

FIG. 6 is a schematic cross-sectional view illustrating that a voice coil is bonded to the diaphragm;

FIG. 7 is a schematic cross-sectional view illustrating the internal magnet type headphone device;

FIG. 8 is a schematic cross-sectional view illustrating the external magnet type headphone device;

FIG. 9 is a schematic cross-sectional view for describing a thickness of the headphone device;

FIG. 10 is a schematic cross-sectional view when the headphone device has a noise canceling function;

FIG. 11 is a schematic cross-sectional view illustrating a configuration of a headphone device according to the present embodiment;

FIG. 12 is a schematic cross-sectional view illustrating an example in which a portion inside a neck section of a diaphragm is formed into a convex shape, a dome section is folded back into a concave shape further on an inner circumference with respect to the convex shape;

FIG. 13 is a schematic cross-sectional view illustrating an example in which forming the dome section into a concave shape causes a center of a protector to be recessed;

FIG. 14 is a schematic cross-sectional view illustrating an example in which the headphone device has a noise canceling function, and a noise pickup microphone is disposed in the concave shape of the dome section; and FIG. 15 is a schematic cross-sectional view illustrating that the headphone device has a feedback type noise canceling function.

DESCRIPTION OF EMBODIMENTS

Hereinafter, (a) preferred embodiment(s) of the present disclosure will be described in detail with reference to the appended drawings. In this specification and the appended drawings, structural elements that have substantially the same function and structure are denoted with the same reference numerals, and repeated explanation of these structural elements is omitted.

The description will be now made in the following order.

1. Background
2. Configuration example of headphone device according to the present embodiment
3. Example in which portion inside neck section of diaphragm is formed into convex shape
4. Example in which center of protector 400 is recessed
5. Example in which headphone device has noise canceling function

1. Background

FIG. 1 is a schematic cross-sectional view illustrating a headphone device 2000 including a dynamic headphone driver. As illustrated in FIG. 1, the headphone device 2000 includes a diaphragm 1100 of a dynamic driver. The diaphragm 1100 is bonded to a voice coil 1200. The diaphragm 1100 is vibrated by the vibration of the voice coil 1200 by the magnetic force of a magnet 1300 provided to a magnetic block (magnet unit) 1500.

The diaphragm 1100 has a dome section 1120 that translates inside the voice coil 1200 in accordance with the amplitude of the voice coil 1200, and an edge section 1130 that transforms, stretches, and shrinks outside the voice coil 1200 in accordance with the amplitude.

Typical speaker other than the headphone device 2000 each vibrate the diaphragm at high amplitude to vibrate the air in relatively large space such as rooms. Meanwhile, the headphone device 2000 vibrates the air in the so narrow space enclosed by an ear and the headphone device 2000 that the diaphragm 1100 of the headphone device 2000 has approximately 1/100 to 1/1000 as high amplitude as the amplitude of the diaphragm of the typical speaker. Similarly, the diaphragm 1100 of the headphone device 2000 weighs approximately 1/100 to 1/1000 as much as the diaphragm of the typical speaker. Different members are used for the dome section and edge section of the typical speaker in some cases because of these differences. A thin film having a thickness of 2 to 100 um is, however, used for the diaphragm 1100 of the headphone device 2000 to integrate the dome section 1120 and the edge section 1130.

FIGS. 2 and 3 are schematic diagrams each illustrating the configuration of a typical speaker. FIGS. 2 and 3 each illustrate a perspective view of the speaker on the top, and a schematic cross-sectional view of the speaker on the bottom. FIG. 2 illustrates a cone speaker 3000. The cone speaker 3000 has an edge section 3020 joined to the outer circumference of a cone-shaped cone section 3010 made of a hard material having rigidity or a dome section made of a hard material. The edge section 3020 is narrow, and made of a soft material. FIG. 3 illustrates a dome speaker 3500. The dome speaker 3500 has an edge section 3520 joined to the outer circumference of a dome section 3510 made of a hard material. The edge section 3520 is narrow, and made of a soft material.

Meanwhile, the structures of the drivers for headphones are totally different from the structures of speakers. FIG. 4 is a plan view illustrating the diaphragm 1100 of the headphone device 2000. FIG. 5 is a schematic cross-sectional view illustrating the shape of the cross section of the diaphragm 1100. As the weight of the vibrating system, a speaker weighs a few grams, while a headphone weighs a few milligrams and is light. The diaphragm 1100 of the headphone device 2000 is formed of an integrated thin film. Accordingly, some shapes provide rigidity to the dome section 1120, and flexibility to the edge section 1130. To secure rigidity, the dome section 1120 is deeply drawn, and shaped like a substantial pointed bullet. To form the edge section 1130 out of an inelastic material, the edge section 1130 is typically wide and low. As a result, the area of the edge section 1130 approximates the area of the dome section 1120 as illustrated in FIG. 5. As illustrated in FIG. 6, the edge section 1130 is approximately ½ as high as the dome section 1120. As illustrated in FIG. 4, the edge section 1130 further has a large number of notches 1132. These notches 1132 stretch and shrink, thereby increasing the flexibility of the edge section 1130.

FIG. 6 is a schematic cross-sectional view illustrating that the voice coil 1200 is bonded to the diaphragm 1100. There is provided a neck section 1140 between the dome section 1120 and the edge section 1130. The neck section 1140 is a narrow flat area. The voice coil 1200 is bonded to the neck section 1140 with an adhesive 1150 heaped up on the neck section 1140.

FIG. 7 is a schematic cross-sectional view illustrating the internal magnet type headphone device 2000. FIG. 8 is a schematic cross-sectional view illustrating the external magnet type headphone device 2000. The magnetic block 1500, which provides a penetration magnetic flux to the voice coil 1200, is configured in many cases as an internal magnet type magnetic block that disposes the magnet 1300 inside the voice coil 1200. The surface of this magnetic block 1500 on the side of the diaphragm 1100 is provided at a position that is necessary amplitude away from the neck section 1140.

The side of the surface of the diaphragm 1100 which is used to wear the headphone device 2000 has an acoustic transmission property, and is provided with a protector 1400 that is strong enough to prevent the diaphragm 1100 from transforming. The protector 1400 is provided at a position that is necessary amplitude away from the tip of the dome section 1120, which is the highest on the diaphragm 1100.

FIG. 9 is a schematic cross-sectional view for describing the thickness of the headphone device 2000. According to the above-described configuration, the thickness of the headphone device 2000 has the value obtained by adding (1) the thickness of the protector 1400, (2) the amplitude of the diaphragm 1100, (3) the height of the dome section 1120, (4) the amplitude of the neck section 1140, and (5) the thickness of the magnetic block 1500.

FIG. 10 is a schematic cross-sectional view illustrating that the headphone device 2000 has a feedback type noise canceling function. FIG. 10 illustrates a mode in which a noise pickup microphone (microphone for picking up noise) 1600 is placed in the internal space of an ear pad. In this case, the noise pickup microphone 1600 is disposed at the center of the protector 1400. The thickness of the headphone device 2000 then has the value obtained by further adding (6) the thickness of the noise pickup microphone 1600 to the additional value of (1) to (5).

2. Configuration Example of Headphone Device According to the Present Embodiment FIG. 11 is a schematic cross-sectional view illustrating the configuration of a headphone device 1000 according to the present embodiment. As illustrated in FIG. 11, the headphone device 1000 according to the present embodiment includes an external magnet type magnetic block 500. Further, a dome section 112 of a diaphragm 110 of the headphone device 1000 according to the present embodiment is formed into a concave shape. The other basic configuration of the headphone device 1000 is similar to that of the external magnet type headphone device 2000 as illustrated in FIG. 8. That is to say, the diaphragm 110 of the headphone device 1000 according to the present embodiment corresponds to the diaphragm 1100 of the headphone device 2000. An edge section 113 and neck section 114 of the diaphragm 110 according to the present embodiment respectively correspond to the edge section 1130 and neck section 1140 of the headphone device 2000. Further, a magnet 300, magnetic block 500, and protector 400 of the headphone device 1000 respectively correspond to the magnet 1300, magnetic block 1500, and protector 1400 of the headphone device 2000.

As illustrated in FIG. 11, the thickness of the headphone device 1000 has the value obtained by adding (1) the thickness of the protector 400, (2) the amplitude of the diaphragm 110, (3) the height of the edge section 113, (4) the amplitude of the neck section 114, and (5) the thickness of the magnetic block 500. Forming the dome section 112 into a concave shape thus considerably reduces the thickness of the headphone device 1000 as compared with the thickness of the external magnet type headphone device 2000 illustrated in FIG. 8. Especially if the dome section 112 is formed into a convex shape as illustrated in FIG. 8, the dome section 1120 is set to be high for rigidity. Accordingly, forming the dome section 112 into a concave shape can considerably reduce the thickness of the headphone device 1000 according to the present embodiment as compared with the thickness of the headphone device 2000 increased by the height of the dome section 1120.

In particular, the headphone device 1000 according to the present embodiment has the dome section 112 formed into a concave shape, and the dome section 112 is located inside the magnetic block 500. Accordingly, it is possible to reduce the thickness of the headphone device 1000.

3. Example in which Portion Inside Neck Section of Diaphragm is Formed into Convex Shape FIG. 12 relates to the configuration of the diaphragm 110 in FIG. 11. FIG. 12 illustrates an example in which there is provided a convex section 115 having a convex shape inside the neck section 114 of the diaphragm 110, and the dome section 112 is folded back into a concave shape further on the inner circumference with respect to the convex section 115. This can further increase the rigidity of the area around the neck section 114 in the radial direction, and offer an advantage in the reproduction of higher frequency sounds. The transformation of the area around the neck section 114 at the time of generating high frequency sounds can prevent the voice coil 200 from transforming, and eliminate the possibility without fail that the sound characteristics are affected at the time of reproduction.

4. Example in which Center of Protector 400 is Recessed

FIG. 13 is a schematic cross-sectional view illustrating an example in which forming the dome section 112 into a concave shape causes the center of the protector 400 to be recessed. FIG. 14 is a schematic cross-sectional view illustrating that the headphone device 1000 illustrated in FIG. 13 is worn on an ear. Forming the dome section 112 into a concave shape makes it possible to recess the center of the driver of the headphone device 1000. Recessing the center of the protector 400 of the earmuff headphone device 1000 makes it possible for the surface of the protector 400 to avoid the convex shape of a pinna 700. Accordingly, the headphone device 1000 can be comfortably worn, and the inner volume of an ear pad 410 can be decreased, allowing for the design of supersensitive headphones.

5. Example in which Headphone Device has Noise Canceling Function

FIG. 15 is a schematic cross-sectional view illustrating an example in which the headphone device 1000 has a feedback type noise canceling function, and a noise pickup microphone 600 is disposed in the concave shape of the dome section 112. Disposing the noise pickup microphone 600 in the concave shape of the dome section 112 causes the thickness of the headphone device 1000 to have the same value as the additional value of (1) to (5) illustrated in FIG. 11. According to the present embodiment, even if the noise pickup microphone 600 is disposed, it is thus possible to keep the thickness of the headphone device 1000 to a minimum. Even if the bigger noise pickup microphone 600 is disposed, the thickness of the headphone device 1000 is not affected. Accordingly, it is possible to enhance the noise canceling performance by disposing the more supersensitive noise pickup microphone 600. It is preferable as an example that the noise pickup microphone 600 have a diameter of approximately 4 mm to 10 mm.

According to the present embodiment as described above, the headphone device 1000 is configured as an external magnet type headphone device, and the dome section 112 of the diaphragm 110 is formed into an outward concave shape. Accordingly, it is possible to considerably reduce the thickness of the headphone device 1000.

It should be understood by those skilled in the art that various modifications, combinations, sub-combinations and alterations may occur depending on design requirements and other factors insofar as they are within the scope of the appended claims or the equivalents thereof.

The invention claimed is:

1. A headphone device, comprising:

an external magnet type magnet unit that is outside a voice coil, and is configured to vibrate the voice coil;

a diaphragm configured to vibrate based on the vibration of the voice coil, wherein the diaphragm includes a dome section, a neck section, and an edge section, the neck section is between the dome section and the edge section, the neck section includes a convex section with an outward convex shape, the diaphragm comprises a material in which the dome section has an outward concave shape on an inner circumference of the voice coil associated with the convex section, and the dome section is continuous with the edge section outside the voice coil;

a protector outside the diaphragm; and a microphone for noise cancellation at a center of the protector, wherein the microphone is in the outward concave shape of the dome section.

2. The headphone device according to claim 1, wherein the protector is configured to protect the diaphragm, and the protector has an outward concave shape.

* * * * *